US007405519B2

(12) United States Patent
Ting et al.

(10) Patent No.: US 7,405,519 B2
(45) Date of Patent: Jul. 29, 2008

(54) FLAT FLUORESCENT LAMP AND DRIVING METHOD THEREOF

(75) Inventors: Chu-Chi Ting, Hualien (TW); Yu-Heng Hsieh, Taipei (TW); Hao-Ping Cheng, Bade (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 291 days.

(21) Appl. No.: 11/386,235

(22) Filed: Mar. 21, 2006

(65) Prior Publication Data

US 2007/0222388 A1 Sep. 27, 2007

(51) Int. Cl.
*H01J 17/30* (2006.01)

(52) U.S. Cl. ..... 313/595; 313/600; 313/494; 349/82; 349/70

(58) Field of Classification Search ..... 313/595, 313/600, 634, 483, 484, 494, 509; 349/70, 349/71, 82, 151, 155, 158; 315/58, 326
See application file for complete search history.

(56) References Cited

U.S. PATENT DOCUMENTS 6,531,922 B1 * 3/2003 Khosrowbeygi et al. .... 330/288
6,820,992 B2 11/2004 Yu et al. ..... 362/633
2002/0163296 A1 11/2002 Hitzschke et al. ..... 313/495
2003/0072146 A1 4/2003 Yu et al. ..... 362/632
2005/0179359 A1 * 8/2005 Fran et al. ..... 313/495
2005/0206298 A1 * 9/2005 Lee et al. ..... 313/495
2007/0228925 A1 * 10/2007 Ting et al. ..... 313/493

FOREIGN PATENT DOCUMENTS

TW 514986 12/2002

* cited by examiner

*Primary Examiner*—Haissa Philogene
(74) *Attorney, Agent, or Firm*—J.C. Patents

(57) ABSTRACT

A flat fluorescent lamp is provided. Wherein, a discharge gas is disposed in a chamber, and a fluorescent material is disposed on a first inner wall and a second inner wall of the chamber. First electrode sets are disposed on the first inner wall, and second electrode sets aligned with the first electrodes sets are disposed on the second inner wall. A dielectric layer overlies the electrode sets. Each first electrode set comprises two first electrodes and a second electrode disposed between these first electrodes. Each second electrode set comprises two third electrodes and a fourth electrode disposed between these third electrodes. A first light-emitting area and a second light-emitting area are formed in each pair of the corresponding first and second electrode sets, and the projections of the first and second light-emitting areas on the first inner wall are not overlaid or just partially overlaid.

19 Claims, 13 Drawing Sheets

FLAT FLUORESCENT LAMP AND DRIVING METHOD THEREOF

BACKGROUND OF THE INVENTION

1. Field of the Invention

The present invention relates to a flat fluorescent lamp and a method for driving the same, and more particularly, to a flat fluorescent lamp that provides an area light source with high light uniformity and a method for driving the same.

2. Description of the Related Art

Along with the continuous development of modern video technology, the liquid crystal display (LCD) device has been widely used as a display screen in the consumer electronic apparatus such as the mobile phones, the notebook computers (a.k.a. the laptop computers), the personal computers (PC) and the personal digital assistants (PDA). However, since the liquid crystal display panel of the LCD device does not emit light, a backlight module has to be installed under the liquid crystal display panel to provide a light source required by the liquid crystal display panel, such that the liquid crystal display panel can display an image on the screen. The main backlight module used in the current market includes the flat fluorescent lamp (FFL), the cold cathode fluorescent lamp (CCFL) and the light emitting diode (LED). Wherein, since the flat fluorescent lamp (FFL) is advantageous in its characteristics of lower price and smaller space, it has been widely applied in the LCD device.

FIG. 1 is a schematic sectional view of a conventional flat fluorescent lamp. Referring to FIG. 1, the conventional flat fluorescent lamp 100 is mainly composed of a top substrate 110 and a bottom substrate 120. Wherein, a discharge room is formed between the top substrate 110 and the bottom substrate 120, and a discharge gas 130 is filled inside the discharge room. A plurality of bottom electrodes 140 is formed on the bottom substrate 120, and a plurality of top electrodes 150 is formed on the top substrate 110. In addition, the top electrodes 150 and the bottom electrodes 140 are respectively overlaid by a dielectric layer 160. Furthermore, a fluorescent material 170 is coated on the top substrate 110, the bottom substrate 120 and the dielectric layer 150.

A conventional method for driving the flat fluorescent lamp 100 includes first providing a driving voltage to the bottom electrodes 140 and the top electrodes 150, such that a discharge electric field E is generated between each pair of the corresponding bottom electrodes 140 and top electrodes 150, and the discharge gas 130 is then dissociated and converted into plasma by the discharge electric field E. Then, while the excited state electrons in each ion of the plasma are back to their ground state, an ultraviolet radiation is emitted. When the ultraviolet radiation emitted by the plasma emits on the fluorescent material 170, the fluorescent material 170 is excited and emits light.

It is to be noted that in the conventional technique, since the discharge electric field E is mainly distributed between each pair of the corresponding salient bottom electrodes 140 and top electrodes 150, the portion above the bottom electrodes 140 and top electrodes 150 of the area light source formed by the flat fluorescent lamp 100 is obviously brighter. In other words, the area light source formed by the conventional flat fluorescent lamp 100 has a distinct light area and dark area, thus the light uniformity of such area light source is rather poor. In addition, in order to improve the light uniformity of the area light source, a diffusion film with a lower transparency is required, which affects the luminance of the area light source. Moreover, when an area light source with a higher luminance is required, the driving voltage of the flat fluorescent lamp 100 needs to be greatly increased, which easily damages the flat fluorescent lamp.

SUMMARY OF THE INVENTION

Therefore, it is an object of the present invention to provide a flat fluorescent lamp that provides an area light source with a better light uniformity.

It is another object of the present invention to provide a method for driving the flat fluorescent lamp so as to improve the light uniformity of the flat fluorescent lamp.

It is yet another object of the present invention to provide a method for driving the flat fluorescent lamp so as to increase the lifespan of the flat fluorescent lamp.

In order to achieve the objects mentioned above and others, the present invention provides a flat fluorescent lamp. The flat fluorescent lamp comprises a chamber, a discharge gas, a fluorescent material, a plurality of first electrode sets, a plurality of second electrode sets and a dielectric layer. Wherein, the discharge gas is disposed inside the chamber, and the chamber has a first inner wall and a second inner wall facing oppositely with each other. The fluorescent material is disposed on the first inner wall and the second inner wall. The first electrode sets are disposed on the first inner wall, and the second electrode sets aligned with the first electrode sets are disposed on the second inner wall. The dielectric layer overlies the first and second electrode sets. In addition, each first electrode set comprises two first electrodes and a second electrode disposed between these two first electrodes. Each second electrode set comprises two third electrodes and a fourth electrode disposed between these two third electrodes. Moreover, a first light-emitting area and a second light-emitting area are formed in each pair of the corresponding first and second electrode sets, and the projections of the first and second light-emitting areas on the first inner wall are not overlaid or just partially overlaid.

In an embodiment of the present invention, each first electrode set further comprises a plurality of first salient points disposed on a first side of the second electrode and a plurality of second salient points disposed on a second side of the second electrode, wherein the first salient points and the second salient points are interleavedly disposed. In addition, each second electrode set further comprises a plurality of third salient points that is disposed on the third electrode on the first side of the second electrode and a plurality of fourth salient points that is disposed on the third electrode on the second side of the second electrode. Moreover, in each pair of the corresponding first and second electrode sets, the first light-emitting area is formed between the first and second salient points and the first electrode, and the second light-emitting area is formed between the third and fourth salient points and the second electrode.

As described above, in each pair of the corresponding first and second electrode sets, the projections of the third salient points on the first inner wall align with the second salient points, and the projections of the fourth salient points on the first inner wall align with the first salient points. In addition, the flat fluorescent lamp further comprises a first inverter and a second inverter. The first inverter has a first contact and a second contact in which each has an opposite electric phase. Wherein, the first contact is electrically connected to the second electrode, and the second contact is electrically connected to the first electrode. The second inverter has a third contact and a fourth contact in which each has an opposite electric phase. Wherein, the third contact is electrically connected to the third electrode, and the fourth contact is electrically connected to the second electrode.

In an embodiment of the present invention, each first electrode set further comprises a plurality of first salient points disposed on a first side of the second electrode and a plurality of second salient points disposed on a second side of the second electrode, wherein the first salient points and the second salient points are interleavedly disposed. In addition, each second electrode set further comprises a plurality of third salient points disposed on a first side of the third electrode and a plurality of fourth salient points disposed on a second side of the third electrode, wherein the third salient points and the fourth salient points are interleavedly disposed. Moreover, in each pair of the corresponding first and second electrode sets, the first light-emitting area is formed between the first and second salient points and the first electrode, and the second light-emitting area is formed between the third and fourth salient points and the first electrode.

As described above, in each pair of the corresponding first and second electrode sets, the projections of the third salient points on the first inner wall align with the second salient points, and the projections of the fourth salient points on the first inner wall align with the first salient points. In addition, the flat fluorescent lamp further comprises a first inverter and a second inverter. The first inverter has a first contact and a second contact in which each has an opposite electric phase. Wherein, the first contact is electrically connected to the second electrode, and the second contact is electrically connected to the first electrode. The second inverter has a third contact and a fourth contact in which each has an opposite electric phase. Wherein, the third contact is electrically connected to the fourth electrode, and the fourth contact is electrically connected to the first electrode.

In an embodiment of the present invention, each first electrode set further comprises a plurality of first salient points disposed on a first side of the second electrode and a plurality of second salient points disposed on a second side of the second electrode, wherein the first salient points and the second salient points are interleavedly disposed. In addition, each second electrode set further comprises a plurality of third salient points that is disposed on the third electrode on the first side of the second electrode and a plurality of fourth salient points that is disposed on the third electrode on the second side of the second electrode. Moreover, in each pair of the corresponding first and second electrode sets, the first light-emitting area is formed between the first and second salient points and the first electrode, and the second light-emitting area is formed between the third and fourth salient points and the fourth electrode.

As described above, in each pair of the corresponding first and second electrode sets, the projections of the third salient points on the first inner wall align with the second salient points, and the projections of the fourth salient points on the first inner wall align with the first salient points. In addition, the flat fluorescent lamp further comprises a first inverter and a second inverter. The first inverter has a first contact and a second contact in which each has an opposite electric phase. Wherein, the first contact is electrically connected to the second electrode, and the second contact is electrically connected to the first electrode. The second inverter has a third contact and a fourth contact in which each has an opposite electric phase. Wherein, the third contact is electrically connected to the third electrode, and the fourth contact is electrically connected to the fourth electrode.

In an embodiment of the present invention, the chamber mentioned above comprises a first substrate, a second substrate, and a frame disposed between the first substrate and the second substrate. Wherein, the surface of the first substrate opposite to the second substrate is regarded as the first inner wall, and the surface of the second substrate opposite to the first substrate is regarded as the second inner wall.

In an embodiment of the present invention, the chamber mentioned above further comprises a plurality of spacers, and the spacers are disposed inside the frame for forming a plurality of discharge rooms. Wherein, a first electrode set and a second electrode set disposed oppositely are disposed in each of the discharge rooms.

In an embodiment of the present invention, the chamber mentioned above further comprises a reflective layer disposed on the first inner wall, and the reflective layer is overlaid by the fluorescent material.

In an embodiment of the present invention, the first, the second, the third and the fourth electrodes are stripe type electrodes.

The present invention further provides a method for driving a flat fluorescent lamp, and the method is suitable for driving the flat fluorescent lamp mentioned above. With such method, the first light-emitting area and the second light-emitting area of the flat fluorescent lamp emit light interleavedly, and the light emitting frequency of the first light-emitting area and the second light-emitting area is between 10 kHz and 500 kHz.

In an embodiment of the present invention, the light emitting frequency of the first light-emitting area and the second light-emitting area is between 40 kHz and 80 kHz.

The present invention further provides a method for driving a flat fluorescent lamp, and the method is suitable for driving the flat fluorescent lamp mentioned above. In the driving method, the first light-emitting area emits light only when the flat fluorescent lamp is turned on at the $n^{th}$ time, and the second light-emitting area emits light only when the flat fluorescent lamp is turned on at the $m^{th}$ time, where n is an odd number, and m is an even number.

The present invention further provides a flat fluorescent lamp comprising a chamber having a first inner wall and a second inner wall facing oppositely with each other, a fluorescent material disposed on the first inner wall and the second inner wall, a plurality of first electrodes and a plurality of second electrodes disposed on the first inner wall, a plurality of third electrodes and a plurality of fourth electrodes disposed on the second inner wall, a plurality of first salient points disposed on the side walls of the first electrodes and the second electrodes, and a plurality of second salient points disposed on the side walls of the third electrodes and the fourth electrodes. Wherein, the first electrodes and the second electrodes are alternately disposed, the third electrodes are disposed opposite to the first electrodes, and the fourth electrodes are disposed opposite to the second electrodes. The first salient points and the second salient points face to the different directions. Moreover, a first light-emitting area is formed between the first salient points and the corresponding first electrodes and second electrodes opposite to the first salient points. A second light-emitting area is formed between the second salient points and the corresponding third electrodes and fourth electrodes opposite to the second salient points, or between the second salient points and the corresponding first electrodes and second electrodes opposite to the second salient points. The first light-emitting area and the second light-emitting area are not overlaid or just partially overlaid.

In an embodiment of the present invention, the projection of the first salient points and the second salient points on the first inner wall are alternately arranged.

In the flat fluorescent lamp of the present invention, since the projections of the first light-emitting area and the second light-emitting area on the first inner wall are not overlaid or just partially overlaid. Accordingly, the first light-emitting area and the second light-emitting area emit light interleavedly, such that the light uniformity of the area light source is improved and the lifespan of the flat fluorescent lamp is increased.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

The present invention is to control the discharge electric field generated between each pair of the corresponding first and second electrode sets in the chamber, such that a first light-emitting area and a second light-emitting area are formed in each pair of the corresponding first and second electrode sets, and the projections of the first and second light-emitting areas on the first inner wall in the chamber are not overlaid or just partially overlaid. The detail description is as following.

First Embodiment

Figure 1:
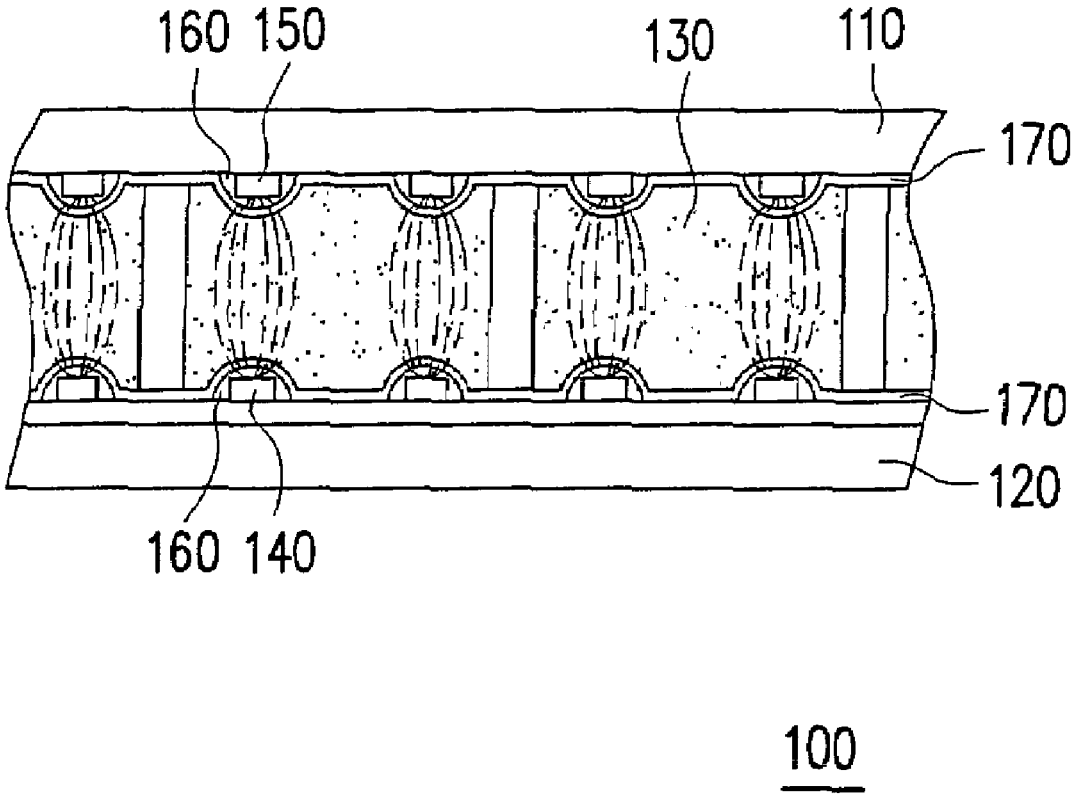
FIG. 1 (PRIOR ART)
FIG. 1 is a schematic sectional view of a conventional flat fluorescent lamp.
Figure 2:
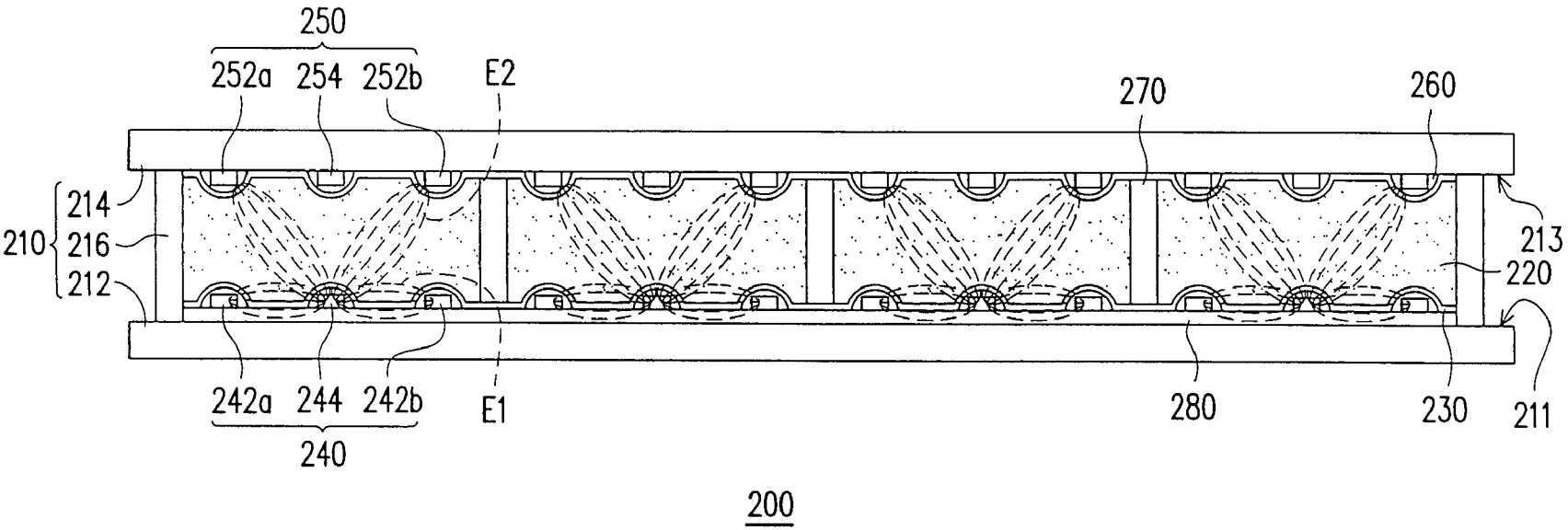
FIG. 2 is a schematic sectional view of a flat fluorescent lamp according to a first embodiment of the present invention.

FIG. 2 is a schematic sectional view of a flat fluorescent lamp according to a first embodiment of the present invention. Referring to FIG. 2, the flat fluorescent lamp 200 of the present embodiment comprises a chamber 210, a discharge gas 220, a fluorescent material 230, a plurality of first electrode sets 240, a plurality of second electrode sets 250 and a dielectric layer 260. Wherein, the discharge gas 220 is disposed inside the chamber 210. The chamber 210 has a first inner wall 211 and a second inner wall 213 that are disposed oppositely, and the fluorescent material 230 is disposed on the first inner wall 211 and the second inner wall 213. The first electrode sets 240 are disposed on the first inner wall 211, and the second electrode sets 250 aligned with the first electrode sets 240 are disposed on the second inner wall 213. The dielectric layer 260 overlies the first electric sets 240 and the second electrode sets 250. In addition, each first electrode set 240 comprises two first electrodes 242*a*, 242*b* and a second electrode 244 disposed between these two first electrodes 242*a*, 242*b*. Each second electrode set 250 comprises two third electrodes 252*a*, 252*b* and a fourth electrode 254 disposed between these two third electrodes 252*a*, 252*b*.

In the first embodiment, the discharge gas is an inert gas such as Xe, Ne, or Ar, and the dielectric layer is made of a ceramic material. In addition, the chamber 210 comprises a first substrate 212, a second substrate 214 and a frame 216 disposed between the first substrate 212 and the second substrate 214. Wherein, the surface of the first substrate 212 opposite to the second substrate 214 is regarded as the first inner wall 211, and the surface of the second substrate 214 opposite to the first substrate 212 is regarded as the second inner wall 213.

The chamber 210 further comprises a plurality of spacers 270 disposed inside the frame 216 for forming a plurality of discharge rooms. Wherein, a first electrode set 240 and a second electrode set 250 disposed oppositely are disposed in each discharge space. In addition, a reflective layer 280 is disposed on the first inner wall 211 of the chamber 210, and the reflective layer 280 is overlaid by the fluorescent material 230. Here, the reflective layer 280 is made of a white ceramic material such as $TiO_2$ or $SiO_2$. Such material is used to reflect the light emitted by the fluorescent material 230, such that the light emerges from the first substrate 214.

Figure 3A:
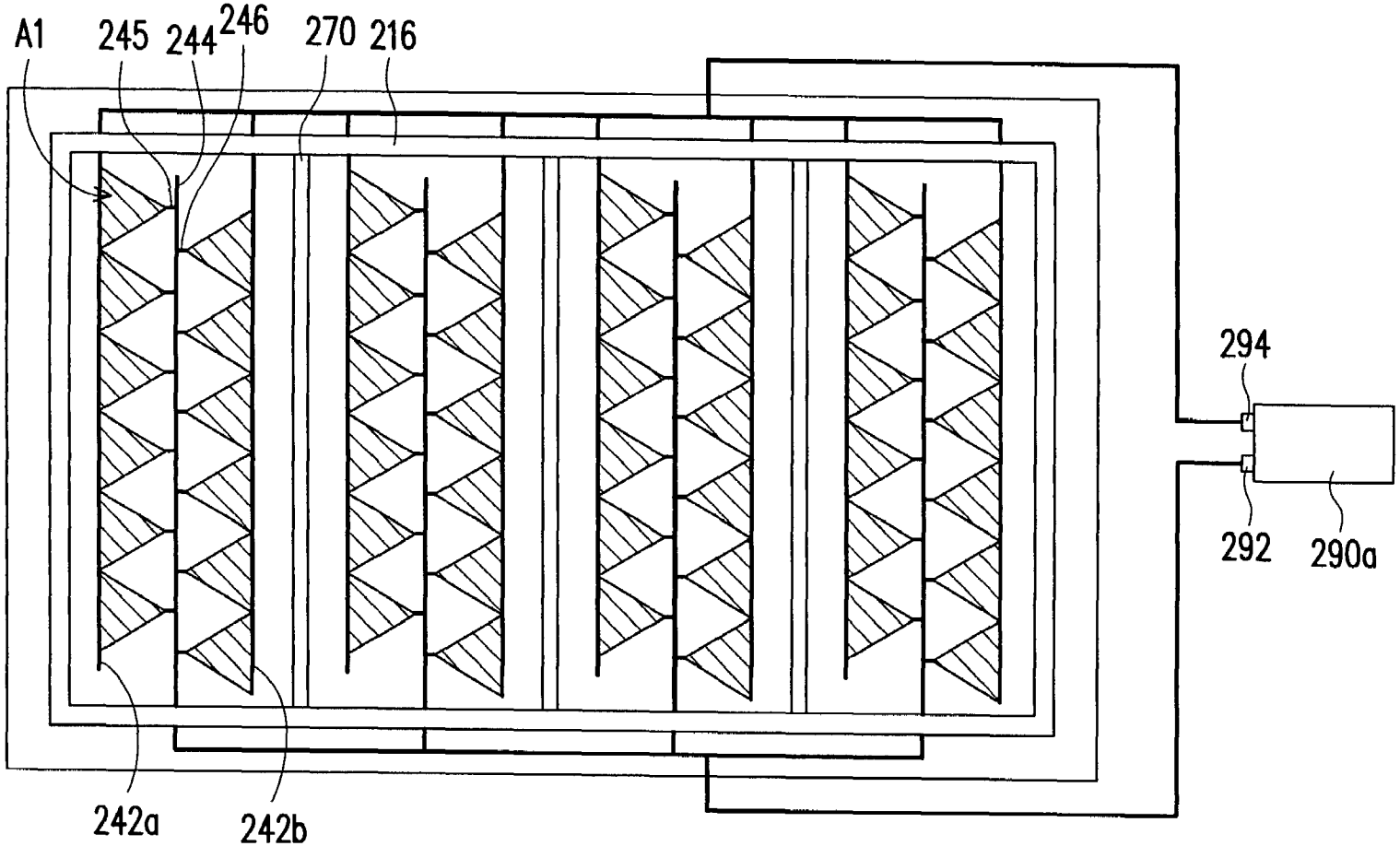
FIG. 3A is a schematic diagram of the first light-emitting area of the flat fluorescent lamp according to the first embodiment of the present invention.
Figure 3B:
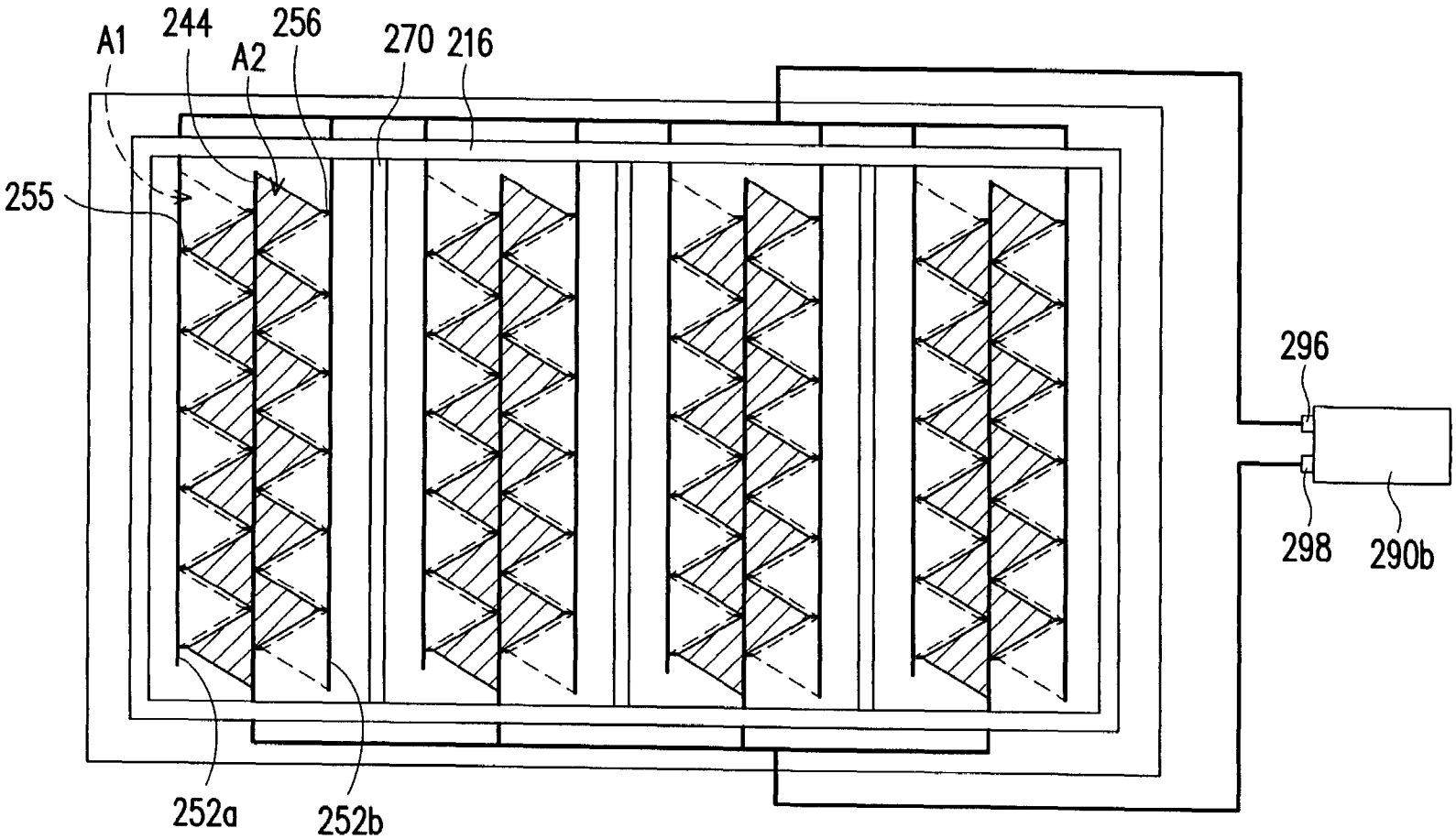
FIG. 3B is a schematic diagram of the second light-emitting area of the flat fluorescent lamp according to the first embodiment of the present invention.

FIG. 3A is a schematic diagram of the first light-emitting area of the flat fluorescent lamp according to the first embodiment of the present invention. FIG. 3B is a schematic diagram of the second light-emitting area of the flat fluorescent lamp according to the first embodiment of the present invention. Referring to FIGS. 2, 3A, and 3B, inside the flat fluorescent lamp 200, the first electrodes 242*a* and 242*b*, the second electrode 244, the third electrodes 252*a* and 252*b* and the fourth electrode 254 are all stripe type electrodes. Each first electrode set 240 further comprises a plurality of first salient points 245 disposed on a first side of the second electrode 244 and a plurality of second salient points 246 disposed on a second side of the second electrode 244, wherein the first salient points 245 and the second salient points 246 are interleavedly disposed. In addition, each second electrode set 250 further comprises a plurality of third salient points 255 that is disposed on the third electrode 252*a* on the first side of the second electrode 244 and a plurality of fourth salient points 256 that is disposed on the third electrode 252*b* on the second side of the second electrode 244.

As described above, the flat fluorescent lamp 200 further comprises a first inverter 290*a* and a second inverter 290*b*. The first inverter 290*a* has a first contact 292 and a second contact 294 in which each has an opposite electric phase. Wherein, the first contact 292 is electrically connected to the second electrode 244, and the second contact 294 is electrically connected to the first electrodes 242*a*, 242*b*. The second inverter 290*b* has a third contact 296 and a fourth contact 298 in which each has an opposite electric phase. Wherein, the third contact 296 is electrically connected to the third electrodes 252*a*, 252*b*, and the fourth contact 298 is electrically connected to the second electrode 244.

When the first inverter 290*a* provides a driving voltage to the first electrodes 242*a*, 242*b* and the second electrode 244, in each pair of the corresponding first electrode set 240 and the second electrode set 250, a first discharge electric field E1 is generated between the first electrodes 242*a*, 242*b* and the second electrode 244, such that a first light-emitting area A1 is formed between the first salient points 245 and the first electrode 242*a* and between the second salient point 245 and the first electrode 242*b*. In addition, when the second inverter 290*b* provides a driving voltage to the third electrodes 252*a*, 252*b* and the second electrode 244, in each pair of the corresponding first electrode set 240 and the second electrode set 250, a second discharge electric field E2 is generated between the third electrodes 252*a*, 252*b* and the second electrode 244, such that a second light-emitting area A2 is formed between the third salient points 255 and the second electrode 244 and between the fourth salient points 256 and the second electrode 244.

It is to be noted that in each pair of the corresponding first electrode set 240 and the second electrode set 250, when the projections of the third salient points 255 on the first inner wall 211 align with the second salient points 246, and the projections of the fourth salient points 256 on the first inner wall 211 align with the first salient points 245, the projections of the first light-emitting area A1 and the second light-emitting area A2 on the first inner wall 211 are not overlaid. In addition, the first light-emitting area A1 can compensate the area not covered by the second light-emitting area A2, and the second light-emitting area A2 can compensate the area not covered by the first light-emitting area A1.

In order to have the first light-emitting area A1 and the second light-emitting area A2 compensated by each other, the present invention especially provides a method for driving the flat fluorescent lamp. The driving method is having the first light-emitting area A1 and the second light-emitting area A2 of the flat fluorescent lamp 200 emit light interleavedly. In the embodiment, the first inverter 290*a* and the second inverter 290*b* are interleavedly driven, such that the first light-emitting area A1 and the second light-emitting area A2 of the flat fluorescent lamp 200 emit light interleavedly. In addition, the light emitting frequency of the first light-emitting area A1 and the second light-emitting area A2 must be higher than the range human eyes can recognize, such as between 10 kHz and 500 kHz, the better is between 40 kHz and 80 kHz, such that the image of the object can be temporarily stilled in human eyes. Since the projections of the first light-emitting area A1 and the second light-emitting area A2 on the first inner wall 211 are not completely overlaid, the areas not covered can be compensated by each other. Accordingly, the flat fluorescent lamp 200 of the present embodiment can provide an area light source with a better light uniformity.

As described above, since the flat fluorescent lamp 200 can provide an area light source with a better light uniformity, the diffusion film with a higher transparency can be used and in some cases it is not even needed, such that the affect of the diffusion film to the luminance of the area light source is decreased. In addition, comparing to the conventional flat fluorescent lamp 100, if an area light source with the same luminance is required, the driving voltage output from the first inverter 290*a* and the second inverter 290*b* of the flat fluorescent lamp 200 of the present embodiment is lower, such that the present embodiment can avoid the flat fluorescent lamp 200 being damaged due to an over high driving voltage. Moreover, since the first light-emitting area A1 and the second light-emitting area A2 are disposed at different locations, the light emitting positions of the fluorescent material 230 are not the same, which increases the lifespan of the flat fluorescent lamp 200.

It is to be noted that the present invention further provides a method for driving a flat fluorescent lamp. In the driving method, the first light-emitting area A1 emits light only when the flat fluorescent lamp 200 is turned on at the $n^{th}$ time, and the second light-emitting area A2 emits light only when the flat fluorescent lamp 200 is turned on at the $m^{th}$ time, where n is an odd number, and m is an even number. With such method, the fluorescent material 230 on different locations in the flat fluorescent lamp 200 emits light interleavedly, such that the lifespan of the flat fluorescent lamp 200 is increased.

Second Embodiment

Figure 4:
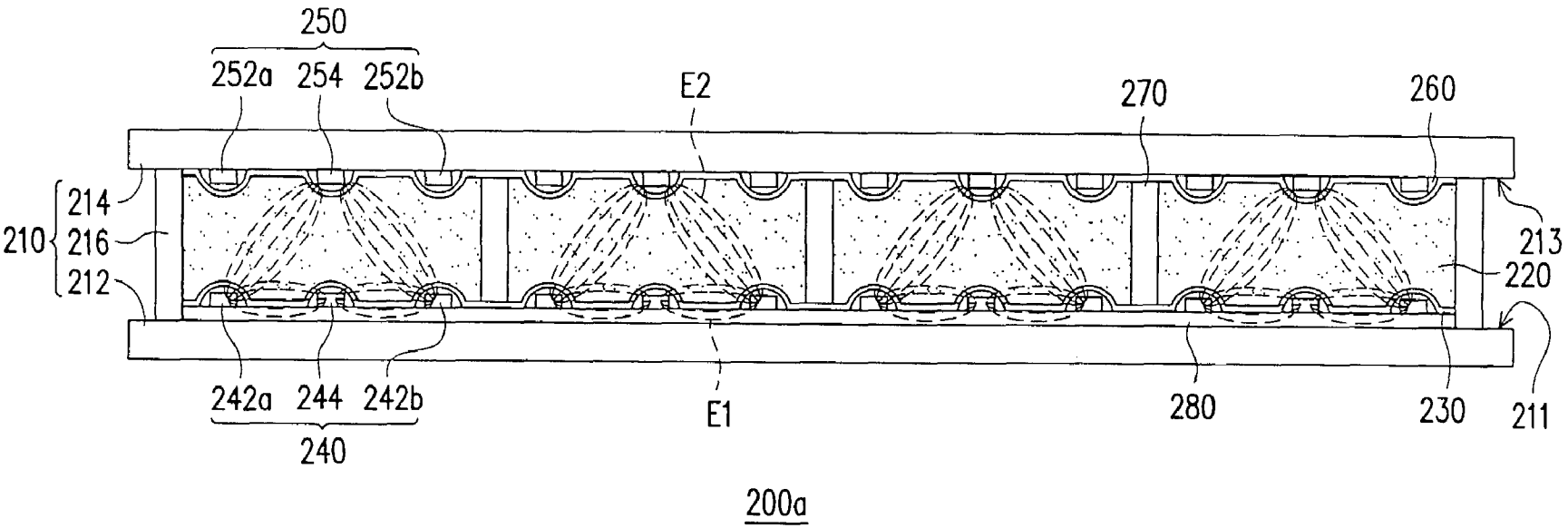
FIG. 4 is a schematic diagram of a discharge electric field of the flat fluorescent lamp according to a second embodiment of the present invention.
Figure 5:
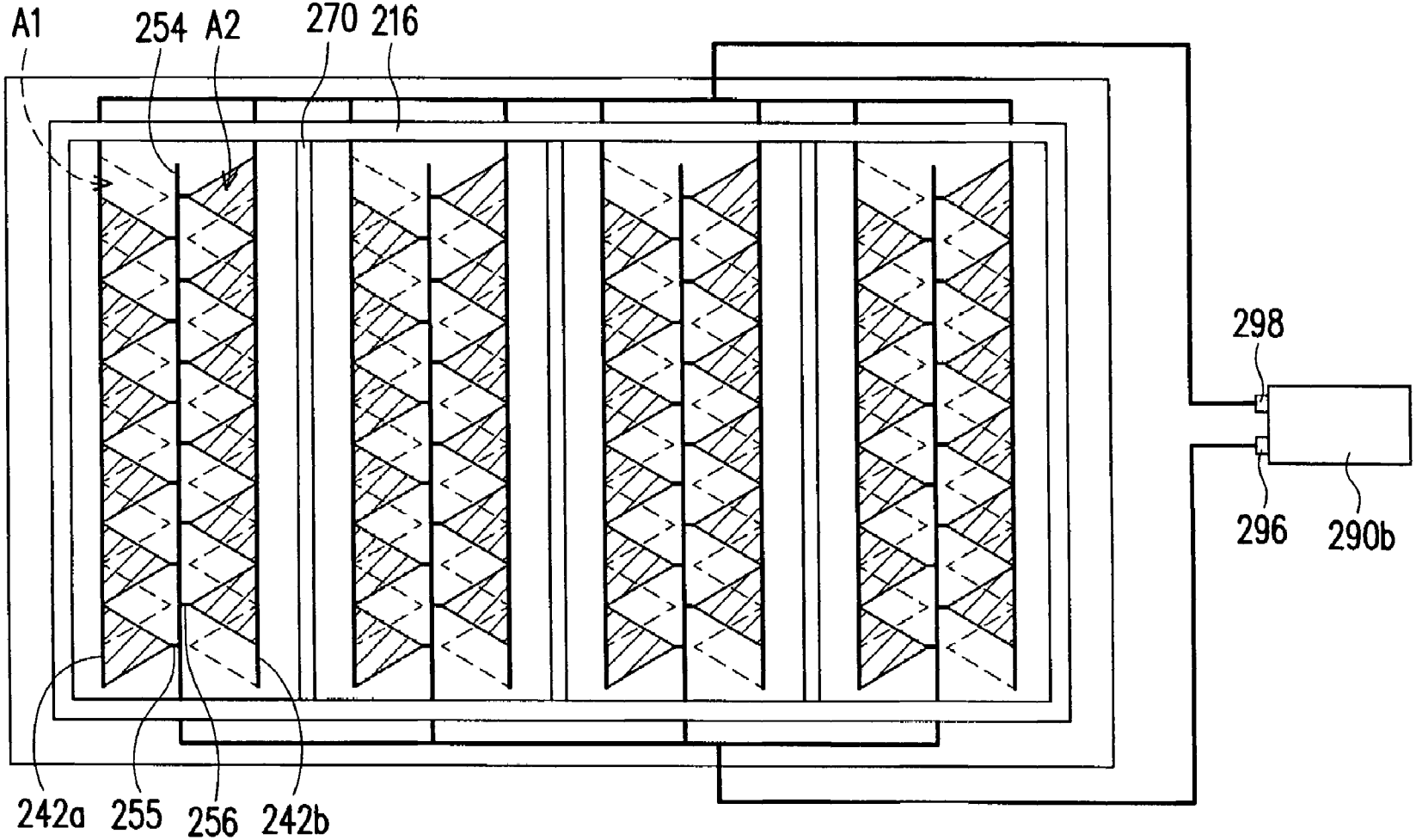
FIG. 5 is a schematic diagram of the second light-emitting area of the flat fluorescent lamp according to the second embodiment of the present invention.

FIG. 4 is a schematic diagram of a discharge electric field of the flat fluorescent lamp according to a second embodiment of the present invention. FIG. 5 is a schematic diagram of the second light-emitting area of the flat fluorescent lamp according to the second embodiment of the present invention. Referring to FIGS. 4 and 5, the flat fluorescent lamp 200*a* of the present embodiment is similar to the flat fluorescent lamp 200 of the first embodiment, and the first light-emitting area of the flat fluorescent lamp 200*a* is the same as the first light-emitting area A1 (as shown in FIG. 3A) of the flat fluorescent lamp 200 in the first embodiment, thus only the different parts are described hereinafter. In the flat fluorescent lamp 200*a* of the present embodiment, the third salient points 255 of the second electrode set 250 are disposed on the first side of the fourth electrode 254, and the fourth salient points 256 are disposed on the second side of the fourth electrode 254. Moreover, the third salient points 255 and the fourth salient points 256 are disposed interleavedly.

In addition, the third contact 296 of the second inverter 290*b* in the flat fluorescent lamp 200*a* is electrically connected to the fourth electrode 254, and the fourth contact 298 is electrically connected to the first electrodes 242*a*, 242*b*. Moreover, in a preferred embodiment of the present invention, in each pair of the corresponding first electrode set 240 and the second electrode set 250, the projections of the third salient points 255 on the first inner wall 211 align with the second salient points 246, and the projections of the fourth salient points 256 on the first inner wall 211 align with the first salient points 245.

When the second inverter 290*b* provides a driving voltage to the first electrodes 242*a*, 242*b* and the fourth electrode 254, in each pair of the corresponding first electrode set 240 and the second electrode set 250, a second discharge electric field E2 is generated between the first electrodes 242*a*, 242*b* and the fourth electrode 254, such that a second light-emitting area A2 is formed between the third salient points 255 and the first electrode 242*a* and between the fourth salient points 256 and the first electrode 242*b*.

Third Embodiment

Figure 6:
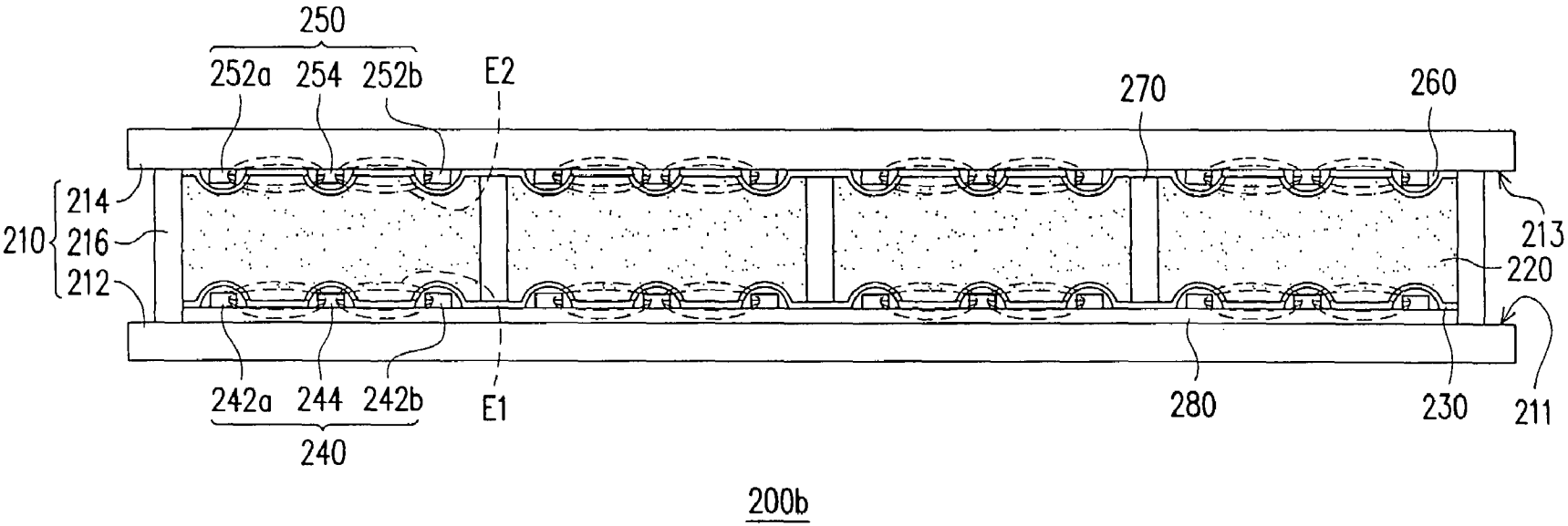
FIG. 6 is a schematic diagram of a discharge electric field of the flat fluorescent lamp according to a third embodiment of the present invention.
Figure 7:
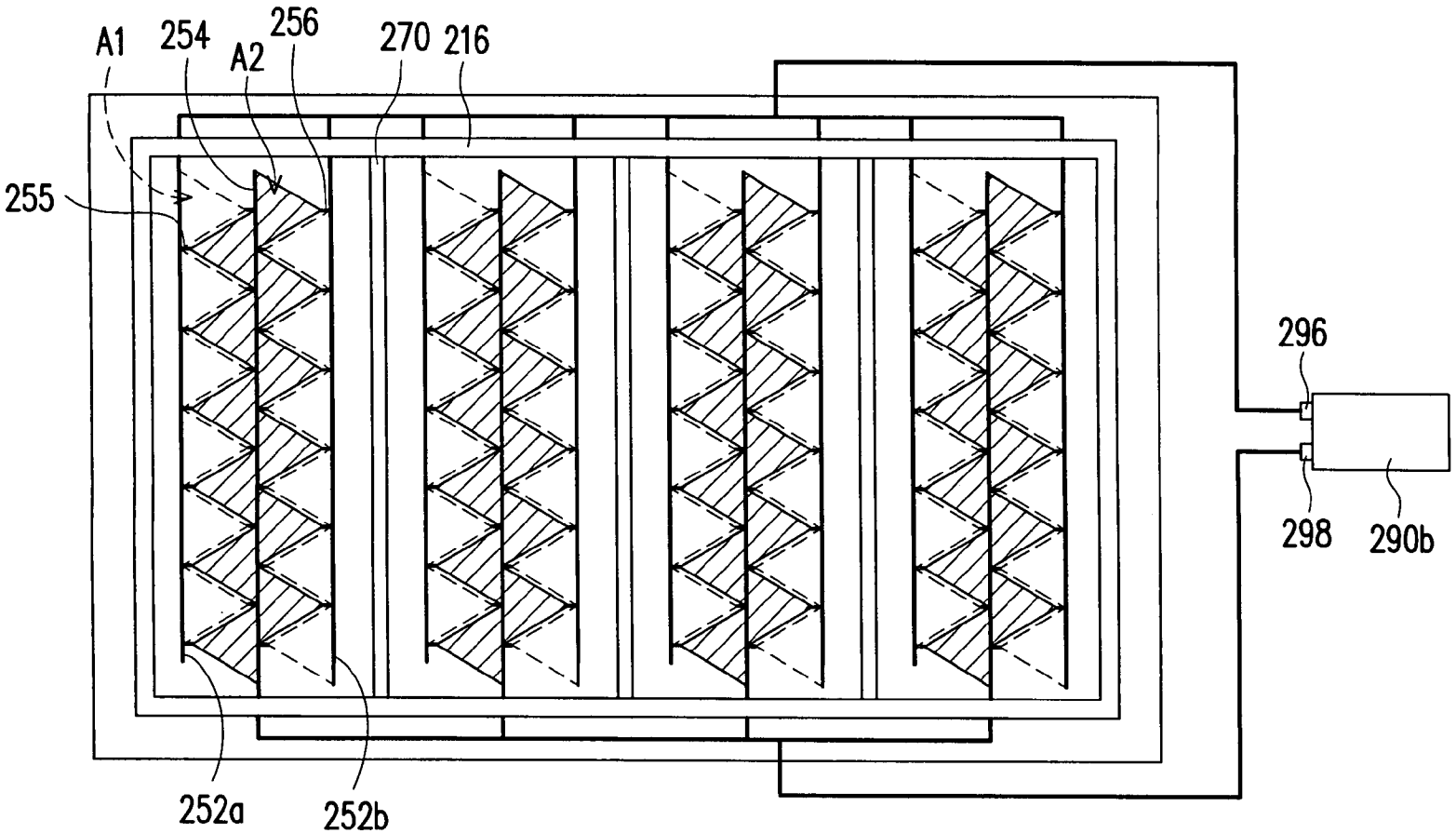
FIG. 7 is a schematic diagram of the second light-emitting area of the flat fluorescent lamp according to the third embodiment of the present invention.

FIG. 6 is a schematic diagram of a discharge electric field of the flat fluorescent lamp according to a third embodiment of the present invention. FIG. 7 is a schematic diagram of the second light-emitting area of the flat fluorescent lamp according to the third embodiment of the present invention. Referring to FIGS. 6 and 7, the flat fluorescent lamp 200*b* of the present embodiment is similar to the flat fluorescent lamp 200 of the first embodiment, and the first light-emitting area of the flat fluorescent lamp 200*b* is the same as the first light-emitting area A1 (as shown in FIG. 3A) of the flat fluorescent lamp 200 in the first embodiment, thus only the different parts are described hereinafter. In the flat fluorescent lamp 200*b* of the present embodiment, the first salient points 245 and the second salient point 256 of the first electrode set 240 and the third salient points 255 and the fourth salient points 256 of the second electrode set 250 are disposed on the same locations of the first embodiment. However, in the present embodiment, the third contact 296 of the second inverter 290*b* is electrically connected to the third electrodes 252*a*, 252*b*, and the fourth contact 298 is electrically connected to the fourth electrode 254.

When the second inverter 290*b* provides a driving voltage to the third electrodes 252*a*, 252*b* and the fourth electrode 254, in each pair of the corresponding first electrode set 240 and the second electrode set 250, a second discharge electric field E2 is generated between the third electrodes 252*a*, 252*b* and the fourth electrode 254, such that a second light-emitting area A2 is formed between the third salient points 255 and the fourth electrode 254 and between the fourth salient points 256 and the fourth electrode 254.

It is to be noted that those two methods for driving the flat fluorescent lamp described in the first embodiment can also be used to drive the flat fluorescent lamp 200*a*, 200*b* of the second embodiment and the third embodiment. Moreover, the advantages of the flat fluorescent lamp 200*a*, 200*b* of the second embodiment and the third embodiment are similar to the flat fluorescent lamp 200 of the first embodiment; please refer to the description in the first embodiment for the details.

Fourth Embodiment

Figure 8:
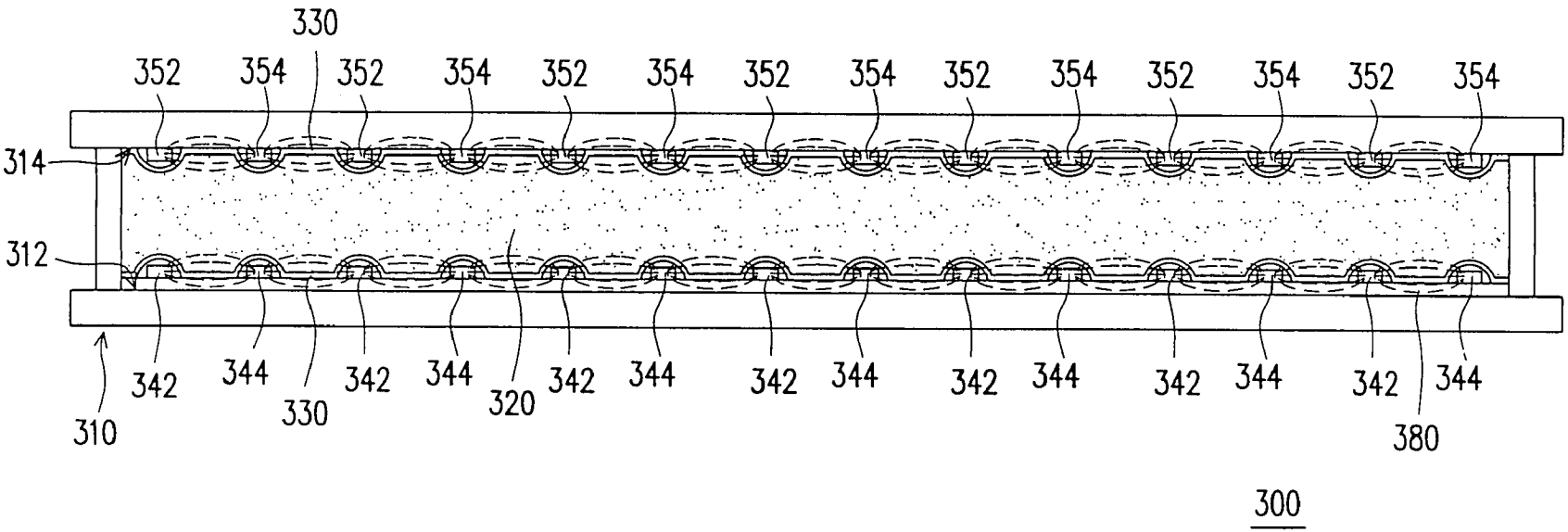
FIG. 8 is a schematic diagram of a discharge electric field of the flat fluorescent lamp according to a fourth embodiment of the present invention.
Figure 9A:
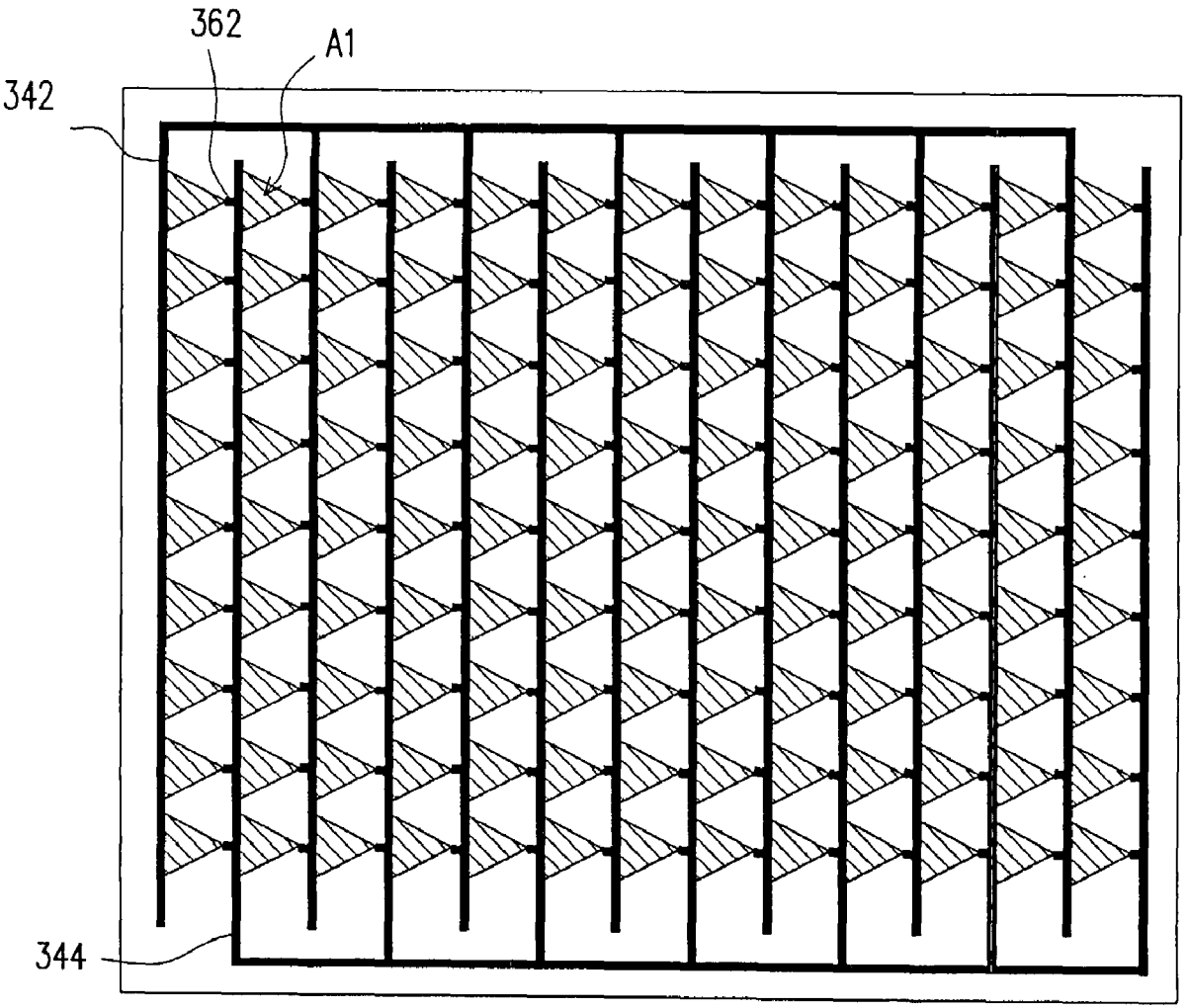
FIG. 9A is a schematic diagram of the first light-emitting area of the flat fluorescent lamp according to the fourth embodiment of the present invention.
Figure 9B:
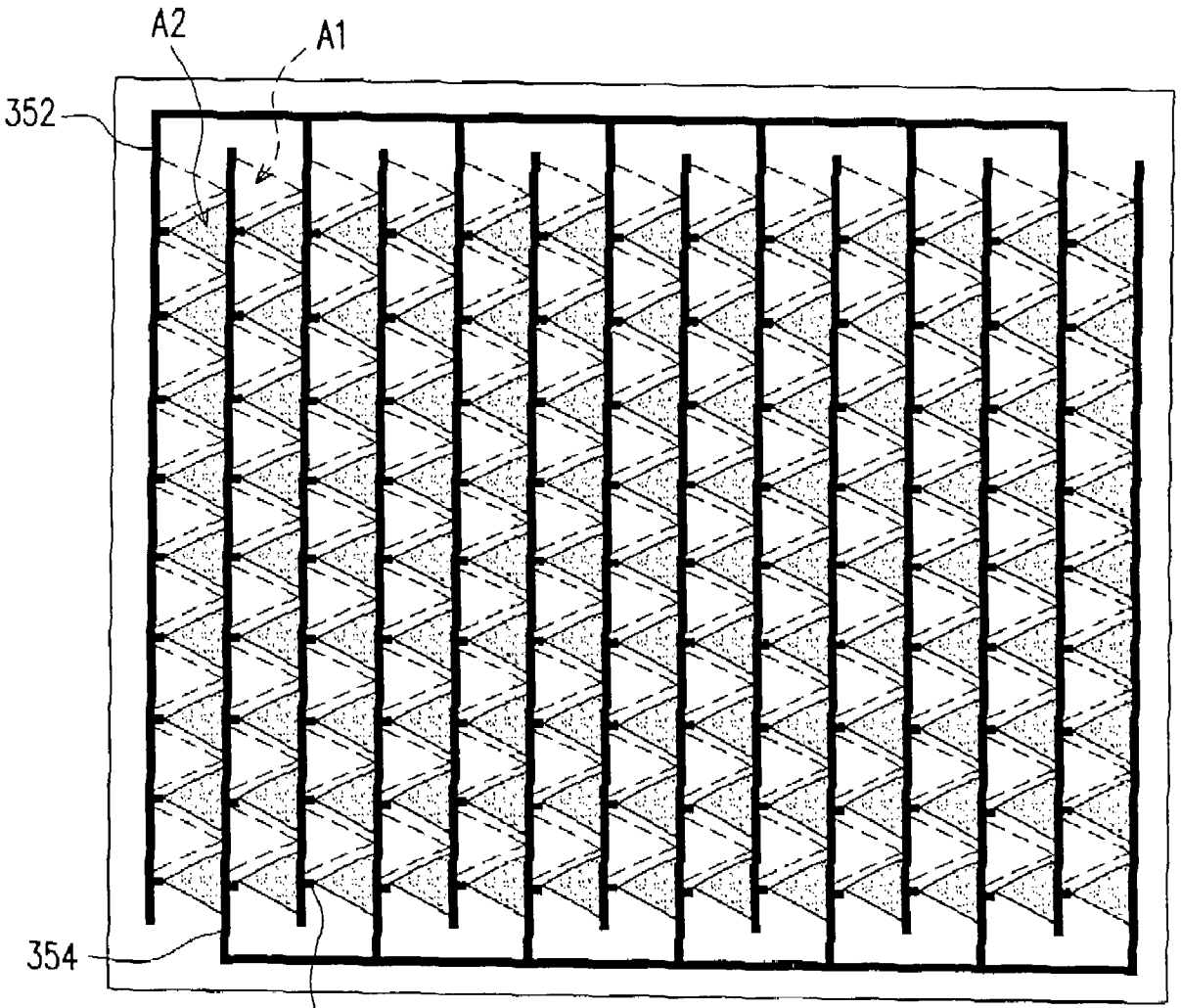
FIG. 9B is a schematic diagram of the second light-emitting area of the flat fluorescent lamp according to the fourth embodiment of the present invention.

FIG. 8 is a schematic diagram of a discharge electric field of the flat fluorescent lamp according to a fourth embodiment of the present invention. FIG. 9A is a schematic diagram of the first light-emitting area of the flat fluorescent lamp according to the fourth embodiment of the present invention. FIG. 9B is a schematic diagram of the second light-emitting area of the flat fluorescent lamp according to the fourth embodiment of the present invention. Referring to FIGS. 8, 9A and 9B, the flat fluorescent lamp 300 of the present embodiment comprises a chamber 310 having a first inner wall 312 and a second inner wall 314 facing oppositely with each other, a fluorescent material 330 disposed on the first inner wall 312 and the second inner wall 314, a plurality of first electrodes 342 and a plurality of second electrodes 344 disposed on the first inner wall 312, a plurality of third electrodes 352 and a plurality of fourth electrodes 354 disposed on the second inner wall 314, a plurality of first salient points 362 disposed on the side walls of the first electrodes 342 and the second electrodes 344, and a plurality of second salient points 364 disposed on the side walls of the third electrodes 352 and the fourth electrodes 354. Wherein, the first electrodes 342 and the second electrodes 344 are alternately disposed, the third electrodes 352 are disposed opposite to the first electrodes 342, and the fourth electrodes 354 are disposed opposite to the second electrodes 344. The first salient points 362 and the second salient points 364 face to the different directions. Moreover, a first light-emitting area A1 is formed between the first salient points 362 and the corresponding first electrodes 342 and second electrodes 344 opposite to the first salient points 362. A second light-emitting area A2 is formed between the second salient points 364 and the corresponding third electrodes 352 and fourth electrodes 354 opposite to the second salient points 364, or between the second salient points 364 and the corresponding first electrodes 342 and second electrodes 344 opposite to the second salient points 364. The first light-emitting area A1 and the second light-emitting area A2 are not overlaid or just partially overlaid.

In the flat fluorescent lamp 300, the projection of the first salient points 362 and the second salient points 364 on the first inner wall 312 are alternately arranged. A reflective layer 380 is disposed on the first inner wall 312 of the chamber 310, and the reflective layer 380 is overlaid by the fluorescent material 330. Further, the first salient points 362 are driven to discharge to the first electrodes 342 and second electrodes 344 opposite to the first salient points 362, such that the first light-emitting area A1 emits light. The second salient points 364 are driven to discharge to the third electrodes 352 and fourth electrodes 354 opposite to the second salient points 364, such that the second light-emitting area A2 emits light.

Fifth Embodiment

Figure 10:
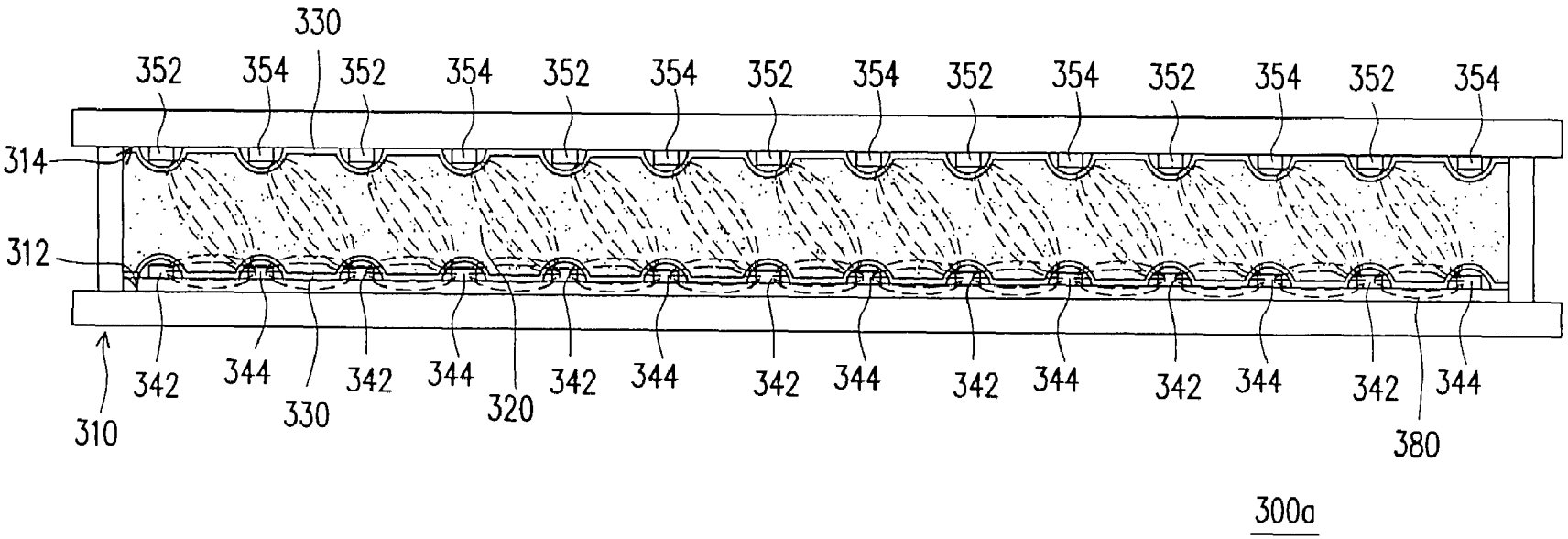
FIG. 10 is a schematic diagram of a discharge electric field of the flat fluorescent lamp according to a fifth embodiment of the present invention.
Figure 11:
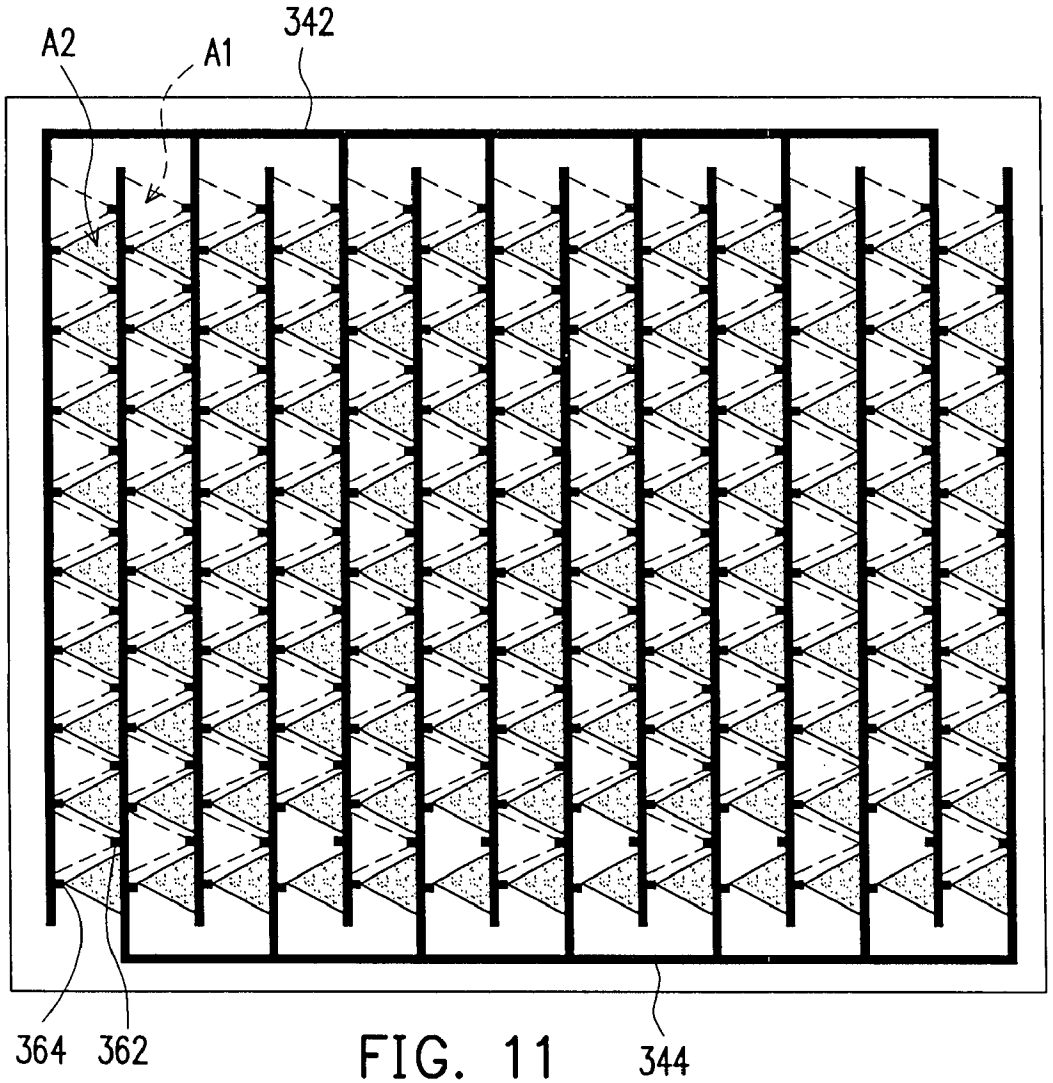
FIG. 11 is a schematic diagram of the second light-emitting area of the flat fluorescent lamp according to the fifth embodiment of the present invention.

FIG. 10 is a schematic diagram of a discharge electric field of the flat fluorescent lamp according to a fifth embodiment of the present invention. FIG. 11 is a schematic diagram of the second light-emitting area of the flat fluorescent lamp according to the fifth embodiment of the present invention. Referring to FIGS. 10 and 11, due to the position of the first electrodes 342 and the third electrodes 352 are overlapped in the FIG. 11 and the position of the second electrodes 344 and the fourth electrodes 354 are overlapped in the FIG. 11, only the first electrodes 342 and the second electrodes 344 are shown in the FIG. 11. Actually, the second salient points 364 shown in the FIG. 11 are connected with the third electrodes 352 and the fourth electrodes 354. The flat fluorescent lamp 300*a* of the present embodiment is similar to the flat fluorescent lamp 300 of the fourth embodiment, and the first light-emitting area of the flat fluorescent lamp 300*a* is the same as the first light-emitting area A1 (as shown in FIG. 9A) of the flat fluorescent lamp 300 in the fourth embodiment, thus only the different parts are described hereinafter. In the flat fluorescent lamp 300*a* of the present embodiment, the first salient points 362 and the second salient points 364 are disposed on the same locations of the fourth embodiment. However, in the present embodiment, the second salient points 364 is driven to discharge to the first electrodes 342 and second electrodes 344 opposite to the second salient points 364, such that the second light-emitting area A2 is formed between the second salient points 364 and the first electrodes 342 and second electrodes 344 opposite to the second salient points 344.

It is to be noted that those two methods for driving the flat fluorescent lamp described in the first embodiment can also be used to drive the flat fluorescent lamp 200, 200*a* of the fourth embodiment and the fifth embodiment. Moreover, the advantages of the flat fluorescent lamp 300, 300*a* of the fourth embodiment and the fifth embodiment are similar to the flat fluorescent lamp 200 of the first embodiment.

In summary, the flat fluorescent lamp and the methods for driving the same provided by the present invention at least have the following advantages:

1. Since the projections of the first light-emitting area and the second light-emitting area on the first inner wall are not overlaid or just partially overlaid, such that the first light-emitting area and the second light-emitting area emit light interleavedly and the light uniformity of the area light source is improved.

2. Since the light emitting positions of the fluorescent material are not the same, the lifespan of the flat fluorescent lamp is increased.

3. Comparing to the conventional technique, under the condition of the same luminance provided by the area light source, since the driving voltage of the flat fluorescent lamp in the present invention is lower, the problem of the flat fluorescent lamp being damaged due to the over high driving voltage is eliminated.

4. Since the flat fluorescent lamp of the present invention can provide an area light source with a better light uniformity, the diffusion film with a higher transparency can be used and in some cases it is not even needed, such that the influence of the diffusion film to the luminance of the area light source is decreased.

Although the invention has been described with reference to a particular embodiment thereof, it will be apparent to one of the ordinary skills in the art that modifications to the described embodiment may be made without departing from the spirit of the invention. Accordingly, the scope of the invention will be defined by the attached claims not by the above detailed description.

What is claimed is:

1. A flat fluorescent lamp, comprising:

a chamber having a first inner wall and a second inner wall disposed oppositely;

a discharge gas disposed inside the chamber;

a fluorescent material disposed on the first inner wall and the second inner wall;

a plurality of first electrode sets disposed on the first inner wall, and each first electrode set comprising:

two first electrodes; and a second electrode disposed between the first electrodes;

a plurality of second electrode sets aligned with the first electrode sets and disposed on the second inner wall, and each second electrode set comprising:

two third electrodes; and a fourth electrode disposed between the third electrodes, wherein a first light-emitting area and a second light-emitting area are formed in each pair of the first electrode set and the second electrode set that are disposed oppositely, and the projections of the first light-emitting area and the second light-emitting area on the first inner wall are not overlaid or just partially overlaid; and a dielectric layer overlying the first electrode sets and the second electrode sets.

2. The flat fluorescent lamp of claim 1, wherein:

each first electrode set further comprises:

a plurality of first salient points disposed on a first side of the second electrode; and a plurality of second salient points disposed on a second side of the second electrode, and the first salient points and the second salient points are disposed interleavedly;

each second electrode set further comprises:

a plurality of third salient points that is disposed on the third electrode on the first side of the second electrode; and a plurality of fourth salient points that is disposed on the third electrode on the second side of the second electrode, wherein in each pair of the corresponding first electrode set and the second electrode set, the first light-emitting area is formed between the first and the second salient points and the first electrodes, and the second light-emitting area is formed between the third and the fourth salient points and the second electrode.

3. The flat fluorescent lamp of claim 2, wherein in each pair of the corresponding first electrode set and the second electrode set, the projections of the third salient points on the first inner wall align with the second salient points, and the projections of the fourth salient points on the first inner wall align with the first salient points.

4. The flat fluorescent lamp of claim 2, further comprising:

a first inverter having a first contact and a second contact being in opposite electric phase, wherein the first contact is electrically connected to the second electrodes, and the second contact is electrically connected to the first electrodes; and a second inverter having a third contact and a fourth contact being in opposite electric phase, wherein the third contact is electrically connected to the third electrodes, and the fourth contact is electrically connected to the second electrodes.

5. The flat fluorescent lamp of claim 1, wherein:

each first electrode set further comprises:

a plurality of first salient points disposed on a first side of the second electrode; and a plurality of second salient points disposed on a second side of the second electrode, and the first salient points and the second salient points are disposed interleavedly;

each second electrode set further comprises:

a plurality of third salient points disposed on a first side of the fourth electrode; and a plurality of fourth salient points disposed on a second side of the fourth electrode, and the third salient points and the fourth salient points are disposed interleavedly, wherein in each pair of the corresponding first electrode set and the second electrode set, the first light-emitting area is formed between the first and the second salient points and the first electrodes, and the second light-emitting area is formed between the third and the fourth salient points and the first electrodes.

6. The flat fluorescent lamp of claim 5, wherein in each pair of the corresponding first electrode set and the second electrode set, the projections of the third salient points on the first inner wall align with the second salient points, and the projections of the fourth salient points on the first inner wall align with the first salient points.

7. The flat fluorescent lamp of claim 5, further comprising:

a first inverter having a first contact and a second contact being in opposite electric phase, wherein the first contact is electrically connected to the second electrodes, and the second contact is electrically connected to the first electrodes; and a second inverter having a third contact and a fourth contact being in opposite electric phase, wherein the third contact is electrically connected to the fourth electrodes, and the fourth contact is electrically connected to the first electrodes.

8. The flat fluorescent lamp of claim 1, wherein:

each first electrode set further comprises:

a plurality of first salient points disposed on a first side of the second electrode; and a plurality of second salient points disposed on a second side of the second electrode, and the first salient points and the second salient points are disposed interleavedly;

each second electrode set further comprises:

a plurality of third salient points that is disposed on the third electrode on the first side of the second electrode; and a plurality of fourth salient points that is disposed on the third electrode on the second side of the second electrode, wherein in each pair of the corresponding first electrode set and the second electrode set, the first light-emitting area is formed between the first and the second salient points and the first electrodes, and the second light-emitting area is formed between the third and the fourth salient points and the fourth electrode.

9. The flat fluorescent lamp of claim 8, wherein in each pair of the corresponding first electrode set and the second electrode set, the projections of the third salient points on the first inner wall align with the second salient points, and the projections of the fourth salient points on the first inner wall align with the first salient points.

10. The flat fluorescent lamp of claim 8, further comprising:

a first inverter having a first contact and a second contact being in opposite electric phase, wherein the first contact is electrically connected to the second electrodes, and the second contact is electrically connected to the first electrodes; and a second inverter having a third contact and a fourth contact being in opposite electric phase, wherein the third contact is electrically connected to the third electrodes, and the fourth contact is electrically connected to the fourth electrodes.

11. The flat fluorescent lamp of claim 1, wherein the chamber comprises:

a first substrate;

a second substrate opposite to the first substrate, wherein the surface of the first substrate opposite to the second substrate is regarded as the first inner wall, and the surface of the second substrate opposite to the first substrate is regarded as the second inner wall; and a frame disposed between the first substrate and the second substrate.

12. The flat fluorescent lamp of claim 11, wherein the chamber further comprises a plurality of spacers disposed inside the frame for forming a plurality of discharge rooms, and the first electrode set and the second electrode set facing oppositely with each other are disposed in each discharge room.

13. The flat fluorescent lamp of claim 1, wherein the chamber further comprises a reflective layer disposed on the first inner wall, and the reflective layer is overlaid by the fluorescent material.

14. The flat fluorescent lamp of claim 1, wherein the first, the second, the third, and the fourth electrodes are stripe type electrodes.

15. A method for driving a flat fluorescent lamp suitable for the flat fluorescent lamp of claim 1, and the method comprising:

having the first light-emitting areas and the second light-emitting areas of the flat fluorescent lamp emitted light interleavedly, and the light emitting frequency of the first light-emitting areas and the second light-emitting areas is between 10 kHz and 500 kHz.

16. The method of claim 15, wherein the light emitting frequency of the first light-emitting areas and the second light-emitting areas is between 40 kHz and 80 kHz.

17. A method for driving a flat fluorescent lamp suitable for the flat fluorescent lamp of claim 1, and the method comprising:

when the flat fluorescent lamp is turned on at the $n^{th}$ time, having the first light-emitting areas emitted light, whereas when the flat fluorescent lamp is turned on at the $m^{th}$ time, having the second light-emitting areas emitted light, where n is an odd number, and m is an even number.

18. A flat fluorescent lamp, comprising:

a chamber having a first inner wall and a second inner wall disposed oppositely;

a discharge gas disposed inside the chamber;

a fluorescent material disposed on the first inner wall and the second inner wall;

a plurality of first electrodes disposed on the first inner wall;

a plurality of second electrodes disposed on the first inner wall, and the first electrodes and the second electrodes are disposed interleavedly;

a plurality of third electrodes disposed on the second inner wall and opposite to the first electrodes;

a plurality of fourth electrodes disposed on the second inner wall and opposite to the second electrodes;

a plurality of first salient points disposed on side walls of the first electrodes and the second electrodes; and a plurality of second salient points disposed on side walls of the third electrodes and the fourth electrodes, and the first salient points and the second salient points face to different directions, wherein, a first light-emitting area is formed between the first salient points and the corresponding first electrodes and second electrodes opposite to the first salient points, a second light-emitting area is formed between the second salient points and the corresponding third electrodes and fourth electrodes opposite to the second salient points, or between the second salient points and the corresponding first electrodes and second electrodes opposite to the second salient points, and the first light-emitting area and the second light-emitting area are not overlaid or just partially overlaid.

19. The flat fluorescent lamp of claim 18, wherein the projection of the first salient points and the second salient points on the first inner wall are alternately arranged.

* * * * *